US011221589B2

(12) United States Patent
Feyer et al.

(10) Patent No.: US 11,221,589 B2
(45) Date of Patent: Jan. 11, 2022

(54) CHRONOGRAPH REPEATER MECHANISM WITH SAFETY FUNCTION

(71) Applicant: OMEGA SA, Biel/Bienne (CH)

(72) Inventors: Julien Feyer, Vernier (CH); Edmond Capt, Le Brassus (CH)

(73) Assignee: OMEGA SA, Biel/Bienne (CH)

( * ) Notice: Subject to any disclaimer, the term of this patent is extended or adjusted under 35 U.S.C. 154(b) by 545 days.

(21) Appl. No.: 16/205,590

(22) Filed: Nov. 30, 2018

(65) Prior Publication Data

US 2019/0187621 A1 Jun. 20, 2019

(30) Foreign Application Priority Data

Dec. 19, 2017 (EP) ..... 17208313

(51) Int. Cl.
*G04B 21/12* (2006.01)
*G04B 21/14* (2006.01)
(Continued)

(52) U.S. Cl.
CPC ..... *G04B 21/12* (2013.01); *G04B 21/00* (2013.01); *G04B 21/04* (2013.01); *G04B 21/14* (2013.01);
(Continued)

(58) Field of Classification Search
CPC ..... G04B 21/00; G04B 21/04; G04B 21/12; G04B 21/14; G04B 25/00; G04F 7/00; G04F 7/089
See application file for complete search history.

(56) References Cited

U.S. PATENT DOCUMENTS 8,588,035 B2 * 11/2013 Goeller ..... G04B 23/12 368/267
8,730,768 B2 * 5/2014 Goeller ..... G04B 23/02 368/66
(Continued)

FOREIGN PATENT DOCUMENTS

| | | |
|---|---|---|
| CH | 102 | 1/1889 |
| CH | 2440 | 11/1890 |
| DE | 17428 | 8/1881 |

OTHER PUBLICATIONS

European Search Report dated Jun. 20, 2018 in European Application 17208313.1 filed on Dec. 19, 2017 (with English Translation of Categories of Cited Documents).

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

An acoustic timepiece display mechanism includes a chronograph repeater for the acoustic display, by a striking mechanism, of a duration measured by a chronograph mechanism. The striking mechanism includes a winding lever for driving a rack to move a striking unit including a rack pinion integral with a striking ratchet, to move a striking rack to read the magnitude concerned and to release a corresponding strike function. The acoustic display mechanism includes, between a control mechanism included in the chronograph mechanism and the winding lever, a safety mechanism arranged, depending on the position of the strike wheel set, to allow or prevent travel of an operating lever of the control mechanism of the chronograph mechanism, which operating lever is arranged to be pivoted under the action of a chronograph start pusher.

7 Claims, 3 Drawing Sheets

(51) Int. Cl.

| | |
|---|---|
| ***G04B 21/04*** | (2006.01) |
| ***G04F 7/00*** | (2006.01) |
| ***G04B 25/00*** | (2006.01) |
| ***G04B 21/00*** | (2006.01) |
| ***G04F 7/08*** | (2006.01) |

(52) U.S. Cl.
CPC ..... *G04B 25/00* (2013.01); *G04F 7/00* (2013.01); *G04F 7/089* (2013.01)

(56) References Cited

U.S. PATENT DOCUMENTS

| | | | | |
|---|---|---|---|---|
| 9,557,715 | B2 * | 1/2017 | Goldmann ..... | G04B 21/12 |
| 10,095,185 | B2 * | 10/2018 | Behra ..... | G04B 21/12 |
| 2006/0133217 | A1 * | 6/2006 | Schmiedchen ..... | G04B 21/00<br>368/110 |
| 2016/0274548 | A1 | 9/2016 | Goldmann | |
| 2016/0342138 | A1 * | 11/2016 | Behra ..... | G04B 21/10 |

* cited by examiner

CHRONOGRAPH REPEATER MECHANISM WITH SAFETY FUNCTION

CROSS-REFERENCE TO RELATED APPLICATION

This application claims priority to European Patent Application No. 17208313.1 filed on Dec. 19, 2017, the entire disclosure of which is hereby incorporated herein by reference.

FIELD OF THE INVENTION

The invention concerns an acoustic timepiece display mechanism with a chronograph repeater for the acoustic display, via a striking mechanism, of a time duration measured by a chronograph mechanism including a control mechanism having a main operating lever arranged to be pivoted under the action of a chronograph start pusher, said striking mechanism comprising an winding lever arranged to drive a rack to move a striking unit including a rack pinion integral with a striking ratchet, to move a striking rack to read the magnitude concerned and to release a corresponding strike function.

The invention also concerns a timepiece, especially a watch, including at least one such acoustic display mechanism.

The invention concerns the field of timepiece display mechanisms.

BACKGROUND OF THE INVENTION

Some timepiece displays are sometimes difficult to read, in particular when the timepiece is a watch of small dimensions, such as a ladies watch, or even a complicated watch, comprising a large number of displays, each then necessarily occupying a restricted surface area, or being superposed on other displays, which can make interpretation imprecise for the user, which is paradoxical when it comes to a precision time measurement.

The reading of a display can also be hampered by low ambient lighting, such as during diving, or at certain times at night or dusk, or may conversely be hampered by interfering light that creates shadows making the indications illegible, or because of the user's visual impairment or particular conditions of employment, such as night flying or certain specific operations. This is why, moreover, horologists in the XVIII and XIX centuries developed striking, passing strike or repeater watches, or tactile watches providing tactile information.

European Patent No EP17206439.6 by the same Applicant discloses a chronograph mechanism connected to an external or internal striking mechanism for providing, particularly on demand, an acoustic display of a time duration measured by the chronograph mechanism; said mechanism being a chronograph repeater. When the striking mechanism is operating, the seconds and tens-of-seconds racks and the minute-beak may be in the way of the seconds, tens-of-seconds and minute cams. If the chronograph mechanism is then started (START), this might stop the movement, with a high risk of breakage. This is why it is necessary to ensure that the chronograph mechanism cannot be set off while the striking mechanism is operating.

Swiss Patent Application No CH102A in the name of REBER discloses improvements to the design of watch repeater mechanisms:

- the lever actuating the repeater has its pivot point on the plate near the centre of the watch, and not on the rack pivot, to ensure a smoother movement of the repeater bolt;
- the two hammers pivot on the same pivot-shank, which saves considerable space; as a result for a repeater watch with a 19" calibre for example, it is possible to use the same trains as for an ordinary 19" watch, whereas in prior art repeaters the hammers took up so much space that ordinary 17" watch trains had to be used, which made the timepiece more expensive;
- instead of placing a pin, to which is hooked a rack carried by the quarter lever and activated by a small spring, on the striking rack, a rack is fixed to the striking rack, and the quarter lever includes a hook-arm formed such that a single strong spring, fixed to the plate and resting on the arm of the spring is used both for dropping the quarter lever onto the quarter snail cam and for hooking the hook to the quarter rack.

SUMMARY OF THE INVENTION

The invention proposes to provide operating safety for a chronograph repeater mechanism, combining a traditional visual display with an acoustic display, or replacing a traditional visual display with an acoustic display, to prevent the chronograph mechanism being released while the striking mechanism is operating.

To this end, the invention concerns a chronograph repeater mechanism for timepieces, by a striking mechanism, of a duration measured by a chronograph mechanism including a control mechanism having a main operating lever arranged to be pivoted under the action of a chronograph start pusher, the striking mechanism comprising an winding lever arranged to drive a rack to move a striking unit including a rack pinion integral with a striking ratchet, to move a striking rack to read the magnitude concerned and to release a corresponding strike function, in which the acoustic striking mechanism includes, between the control mechanism and the winding lever, a safety mechanism arranged, depending on the position of the strike wheel set, to allow or prevent travel of the operating lever.

The invention also concerns a timepiece, especially a watch, including at least one such chronograph repeater mechanism.

BRIEF DESCRIPTION OF THE DRAWINGS

Other features and advantages of the invention will appear from reading the following detailed description, with reference to the annexed drawings, in which:

FIG. 1 corresponds to the rest position of the striking mechanism, with an winding pusher in a standby position, ready to be depressed by an winding lever.

FIG. 2 shows the fully depressed position of said same winding pusher, after said winding lever has been fully depressed, which causes a strike rack to pivot, initialising a cycle of striking the value measured by the chronograph mechanism, any release of the chronograph mechanism operating lever is thus hindered by the safety mechanism according to the invention.

DETAILED DESCRIPTION OF PREFERRED EMBODIMENTS

Figure 1:
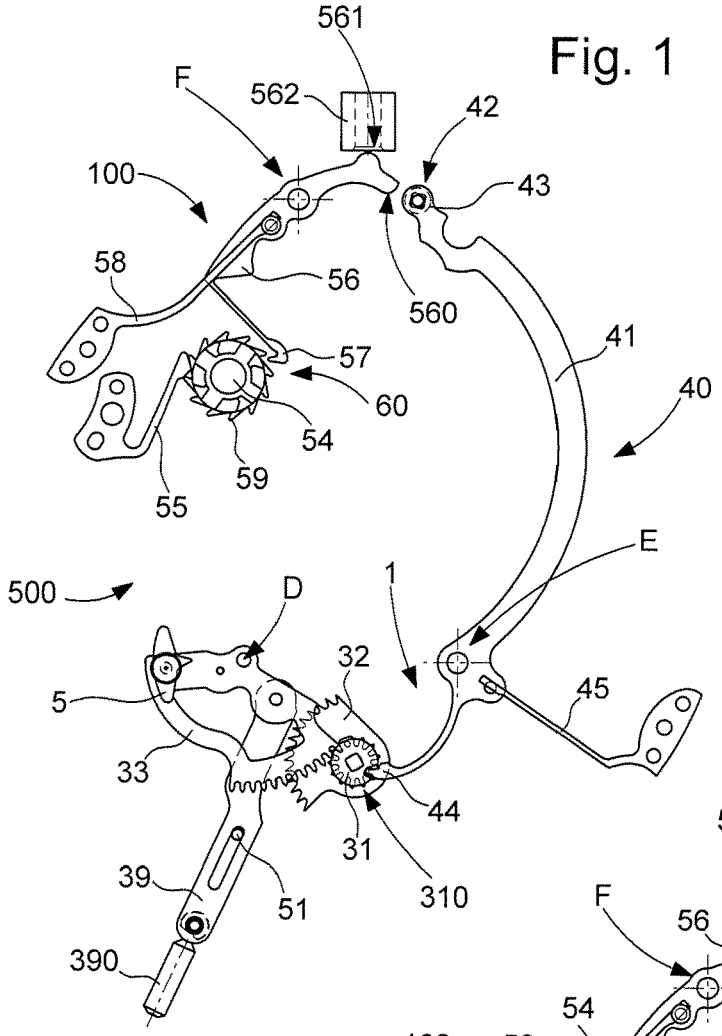
FIGS. 1 and 2 represent schematic, plan views of a detail of a chronograph repeater mechanism according to the invention, showing a safety mechanism according to the invention between the control mechanism of the chronograph mechanism, and the repeater control mechanism, illustrated in the particular and non-limiting case where the control mechanism of the chronograph mechanism includes a column wheel.

The invention concerns an acoustic timepiece display mechanism 500 for a timepiece 1000, especially a watch, or a sports timing device or otherwise, or a clock, or otherwise.

This timepiece 1000 includes, in a conventional manner, a movement, and energy storage means, for at least driving an oscillator, which are not described in detail here. This timepiece 1000 may also consist of a music box.

This display mechanism 500 includes at least one rotating display wheel set, connected in particular to a display member such as a hand, disc or suchlike, for the display of a magnitude other than the current time. A 'magnitude other than the current time of day' means a magnitude such as a time duration for a chronograph mechanism, or a total number of actions on a pusher for a sports referee device, or suchlike.

This display mechanism 500 is an acoustic display mechanism. To this end, the rotating display wheel set is integral, at least in rotation, with a display cam whose rim cooperates with the beak of a striking rack comprised in a striking mechanism 1, which is integrated in or juxtaposed with display mechanism 500, for striking a numerical value characteristic of the measured magnitude.

The invention is more particularly described, in a non-limiting manner, for an on-demand display, by action of a user on a control member, such as winding pusher 390 as illustrated by the Figures, or a bolt, crown, bezel or any other actuator.

In the particular and non-limiting application illustrated by the Figures, this display mechanism 500 includes a chronograph mechanism 100 which includes at least a centre chronograph wheel for counting the seconds, and a minute-counter wheel for counting the minutes.

More particularly, this display mechanism 500 is a chronograph repeater mechanism, as described in European Patent Application EP17206439.6 by the same Applicant. This chronograph repeater mechanism is arranged to provide, after stopping at the end of a measurement of a timed duration made by chronograph mechanism 100, information relating to the timed duration, particularly in minutes and seconds, to a striking mechanism 1 comprised in chronograph mechanism 100 or with which chronograph mechanism 100 is juxtaposed, in order to strike at least the minutes and the seconds of the timed duration. This striking mechanism 1 includes the required striking control components (particularly for the minutes and seconds, or tens of seconds or otherwise), for striking at least the units corresponding to the timed duration.

This acoustic timepiece display mechanism 500 with a chronograph repeater makes possible the acoustic display, by striking mechanism 1, of a timed duration via a chronograph mechanism 100.

According to the invention, this striking mechanism 1 includes an winding lever 39, which is arranged to start the reading of the timed duration on the snails and cams and to drive a rack 33 against elastic return means forming drive means for striking mechanism 1, to move a striking unit including a rack pinion 31 integral with a striking ratchet 32, and to move a striking rack for each display cam to read the magnitude concerned, for example a minute rack on a minute snail cam, a seconds rack on a seconds snail cam, a tens-of-seconds rack on a tens-of-seconds cam or suchlike, and to release a corresponding striking function.

According to the invention, said acoustic display mechanism 500 includes, between the control mechanism of chronograph mechanism 100 and the winding lever 39, a safety mechanism 40, which, depending on the position of the strike wheel set, and more particularly but not exclusively of rack pinion 31, is arranged to allow or prevent travel of an operating lever 56, comprised in the control mechanism of chronograph mechanism 100, and which is arranged to be pivoted under the action of a chronograph start pusher 562.

Chronograph mechanism 100 includes, in a conventional manner, user-accessible external control means, such as a start/stop pusher, return-to-zero pusher, or similar, and particularly as described in the collective work '*Théorie d'horlogerie*' by Messrs Reymondin, Monnier, Jeanneret, Peleratti, edited by the FET (Federation of Technical Schools), Switzerland, in chapter 11. For the start/stop function, these external control means generally drive an operating lever 56, which pushes or pulls a control cam 60, especially a pivoting cam, such as a column wheel 54, or a cam comprising an upper cam and a lower cam, or otherwise.

The invention is applicable both to a chronograph with a single pusher as illustrated in the Figures, used for the START, STOP and RESET functions, and to a chronograph mechanism with two pushers, one for the start/stop function, and the other for the reset function, by the same logic, which, when the striking mechanism is manually actuated, consists of an isolating mechanism including a safety lever described below, arranged to make any pressure on the single pusher, or any of the pushers as appropriate, impossible, by the interposition of a stud underneath each pusher concerned.

More particularly, the control mechanism of chronograph mechanism 100 includes a chronograph start pusher 562, arranged to exert pressure on operating lever 56, which is subject to the return force of an operating lever spring 58 and which is a lever that pivots about an operating lever axis F. In the non-limiting embodiment illustrated, this operating lever 56 is provided with a hook 57, arranged for maneuvering the ratchet 59 of a control cam 60, such as column wheel 54 in the non-limiting variant illustrated by the Figures, or a control cam, or otherwise, which control cam 60 is held in position by a jumper 55 or similar. Chronograph mechanism 100 includes at least one rotating display wheel set, such as the seconds wheel set or the minute wheel set, which is integral, at least in rotation, with a corresponding display cam, whose rim cooperates with the beak of a corresponding striking rack, comprised in striking mechanism 1, to strike a numerical value characteristic of a timed duration measured by chronograph mechanism 100.

Figure 2:
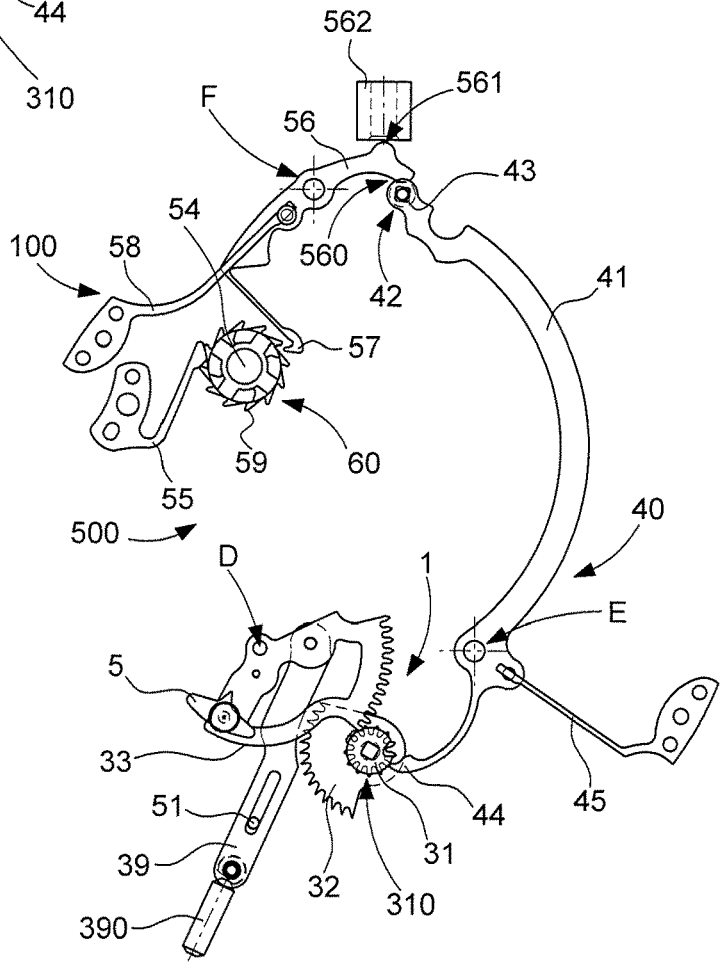
Figure 3:
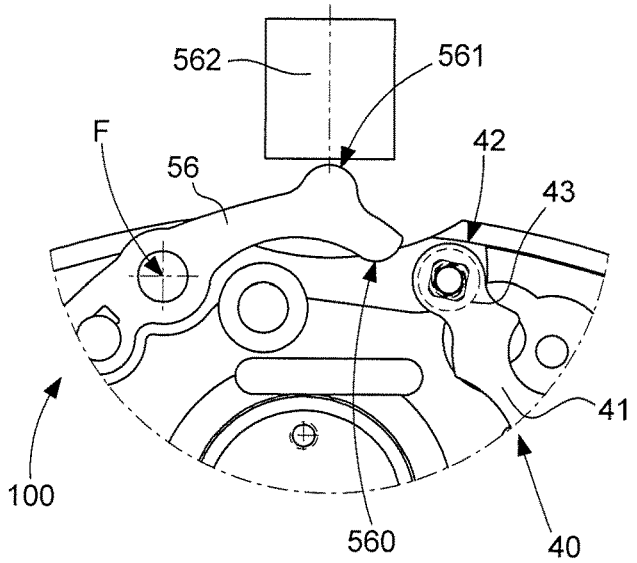
FIG. 3 is a detail of FIG. 1, showing the end of a chronograph start pusher capable of acting on a chronograph control lever.
Figure 4:
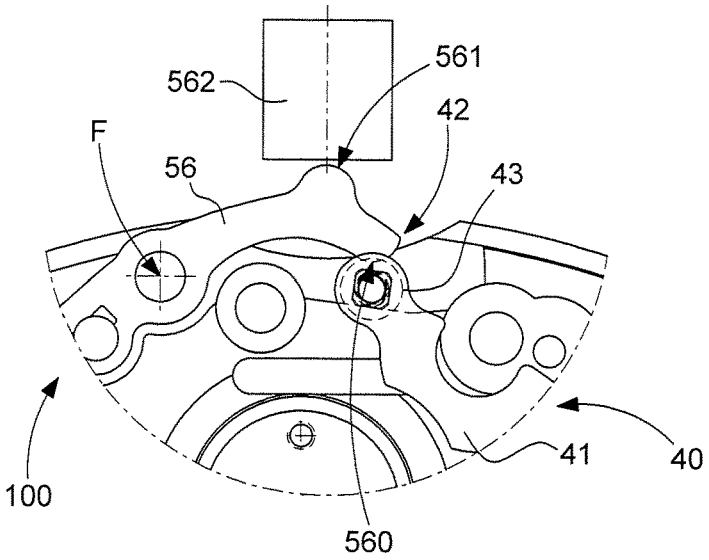
FIG. 4 is a detail of FIG. 2, showing the end of a chronograph start pusher bearing on a chronograph control lever, which is locked by a stud comprised in the safety mechanism according to the invention and which prevents the chronograph control lever pivoting.
Figure 5:
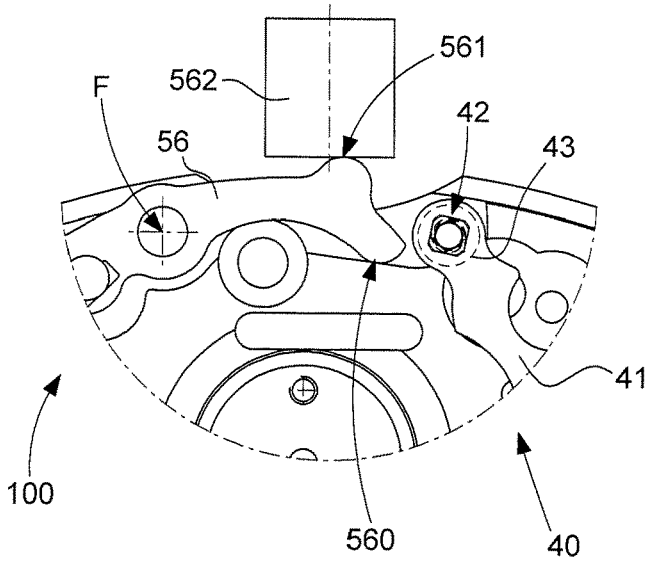
FIG. 5 shows the chronograph control lever in a pivoted position engaging the chronograph mechanism, which is allowed by withdrawal of the stud of the safety mechanism according to the invention after a striking function has completely finished, especially the chronograph repeater function.
Figure 6:
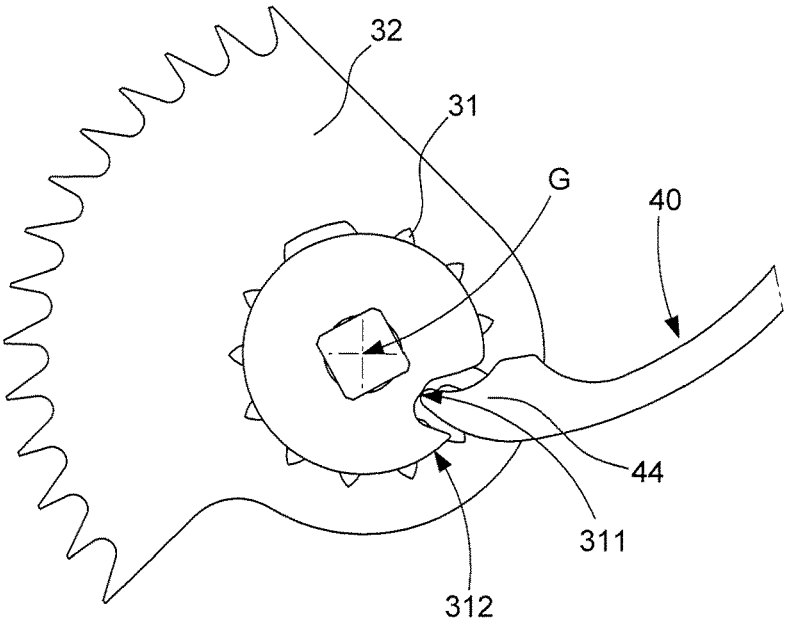
FIGS. 6 and 7 are details which illustrate, in two positions respectively corresponding to FIGS. 1 and 2, the cooperation between a first end of the safety lever and a two-level cam which is integral with the rack pinion.
Figure 7:
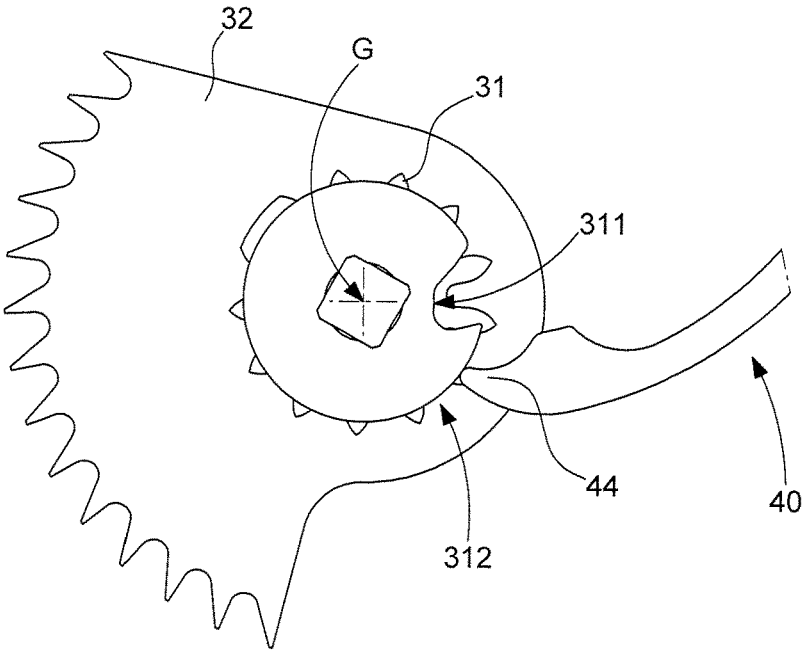
Figure 8:
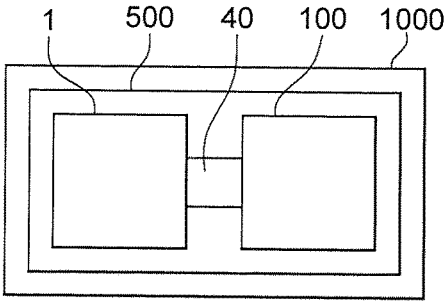
FIG. 8 is a block diagram representing a timepiece, especially a watch, wherein the striking mechanism is integrated in the display mechanism.

Safety mechanism 40 is arranged, depending on the position of the striking wheel set, and more particularly but not exclusively rack pinion 31, to allow or prevent travel of operating lever 56. To this end, in the variant illustrated by the Figures, this mechanical safety connection includes a safety lever 41 pivotably mounted on a safety axis E. A first end 44 of safety lever 41 is abuttingly engaged with a cam 310 having two levels: lower level 311 and upper level 312, which is integral with rack pinion 31, under the action of an elastic return means, in particular a safety spring 45. The second end 42 of safety lever 41 includes a stud 43 which is arranged to be interposed on the trajectory of operating lever 56, depending on the angular position of safety lever 41:

when the striking mechanism is operating, as seen in FIGS. 2 and 4, stud 43 prevents operating lever 56 pivoting under any pressure applied by a user to the chronograph start pusher 562;

when the striking mechanism is not operating or no longer operating, as seen in FIGS. 1, 3 and 4, stud 43 does not prevent operating lever 567 pivoting under pressure applied by a user to chronograph start pusher 562. FIG. 5 shows the depressed position of chronograph start pusher 562.

It is understood that this configuration avoids any risk of stopping or breaking the movement: the user can only start chronograph mechanism 100 when he is entitled to do so, i.e. when striking mechanism 1 is inoperative.

The invention can implement a more complex striking mechanism than those shown in the aforementioned reference work, particularly with several striking functions or melodies as in the patent applications in the name of BLANCPAIN: traditional striking or melody playing function, striking mechanism with several stages with different rack components.

The invention also concerns a timepiece 1000, particularly a watch, including such a display mechanism 500.

In one embodiment, striking mechanism 1 is distinct from display mechanism 500.

In another embodiment, striking mechanism 1 is integrated in said display mechanism 500.

Although the acoustic display mechanism described above is designed to be combined with a conventional visual display, it can also replace the latter.

The invention allows a useful safety function to be added to a chronograph repeater display mechanism, which combines a chronograph mechanism and a striking mechanism, which are known to be the most complex and delicate timepiece mechanisms, and which must be protected from any mishandling.

The invention claimed is:

1. An acoustic timepiece display mechanism comprising a chronograph repeater for the acoustic display, by a striking mechanism, of a duration measured by a chronograph mechanism including a control mechanism having a main operating lever arranged to be pivoted under the action of a chronograph start pusher, said striking mechanism comprising an winding lever arranged to drive a rack to move a striking unit including a rack pinion integral with a striking ratchet, to move a striking rack to read a magnitude concerned and to release a strike function corresponding to the magnitude concerned, wherein said acoustic striking mechanism includes, between said control mechanism and said winding lever, a safety mechanism arranged, depending on a position of said rack pinion, to allow or prevent travel of said operating lever.

2. The acoustic display mechanism according to claim 1, wherein said striking mechanism includes at least one said striking rack formed by at least one of a minute rack arranged to cooperate with a minute snail cam, a tens-of-seconds rack arranged to cooperate with a tens-of-seconds cam, and a seconds rack arranged to cooperate with a seconds snail cam, and wherein said chronograph mechanism includes at least one rotating display wheel set integral, at least in rotation, with at least one of the minute snail cam, the tens-of-seconds cam, and the seconds snail cam arranged to respectively cooperate with the minute rack, the tens-of-seconds rack, and the seconds rack, and a rim of the at least one rotating display wheel is arranged to cooperate with a beak of at least one of the minute rack, the tens-of-seconds rack, and the second rack, and wherein said winding lever is arranged to start a reading of a timed duration on at least one of the minute snail cam, the tens-of-seconds cam, and the seconds snail cam respectively corresponding to the minute rack, the tens-of-seconds rack, and the seconds rack, and to drive the rack against elastic return means forming drive means for said striking mechanism in order to read the magnitude concerned.

3. The acoustic display mechanism according to claim 1, wherein said safety mechanism includes at least one safety lever, arranged to cooperate at a first end bearing on a cam with two levels, comprised in said striking unit, under action of elastic return means, and including, at a second opposite end, a stud which is arranged to be interposed on a trajectory of said operating lever, depending on an angular position of said at least one safety lever.

4. A timepiece comprising the acoustic display mechanism according to claim 1.

5. The timepiece according to claim 4, wherein said striking mechanism is distinct from said acoustic display mechanism.

6. The timepiece according to claim 4, wherein said striking mechanism is integrated in said acoustic display mechanism.

7. The timepiece according to claim 4, wherein said timepiece is a watch.

* * * * *